US008307475B2

(12) United States Patent
Hutchinson et al.

(10) Patent No.: US 8,307,475 B2
(45) Date of Patent: Nov. 13, 2012

(54) PLAY YARD WITH MOTORIZED SWINGING BASSINET

(75) Inventors: James M. F. Hutchinson, Mohnton, PA (US); Derek A. King, Mukwonago, WI (US); Peter R. Tuckey, Morgantown, PA (US); Jonathan M. Pacella, Coatesville, PA (US)

(73) Assignee: Wonderland Nurserygoods Co., Ltd, Taipei (TW)

( * ) Notice: Subject to any disclaimer, the term of this patent is extended or adjusted under 35 U.S.C. 154(b) by 729 days.

(21) Appl. No.: 12/254,963

(22) Filed: Oct. 21, 2008

(65) Prior Publication Data

US 2009/0113625 A1 May 7, 2009

Related U.S. Application Data

(60) Provisional application No. 61/001,428, filed on Nov. 1, 2007, provisional application No. 61/062,355, filed on Jan. 25, 2008, provisional application No. 61/125,733, filed on Apr. 28, 2008.

(51) Int. Cl.
*A47D 7/00* (2006.01)

(52) U.S. Cl. ..... 5/93.1; 5/109

(58) Field of Classification Search ..... 5/93.1, 5/93.2, 98.1–99.1, 101–103, 108, 109, 655, 5/417, 420; 297/273; 472/119
See application file for complete search history.

(56) References Cited

U.S. PATENT DOCUMENTS

| | | | | |
|---|---|---|---|---|
| 2,553,579 | A | 5/1951 | Harris | 5/99 |
| 2,884,651 | A * | 5/1959 | Garey | 5/109 |
| 3,668,721 | A * | 6/1972 | Jenkins | 5/109 |
| 3,738,700 | A | 6/1973 | Terry | 296/27 |
| 3,769,641 | A | 11/1973 | Harper | 5/109 |
| 4,258,446 | A | 3/1981 | McAllister | 5/109 |
| 4,615,059 | A | 10/1986 | Darowski | 5/108 |
| 5,048,135 | A | 9/1991 | Chen | 5/109 |
| 5,274,863 | A | 1/1994 | Fountain | 5/120 |
| 5,349,709 | A * | 9/1994 | Cheng | 5/93.1 |
| 5,713,089 | A * | 2/1998 | Ferrante | 5/502 |
| 5,742,960 | A | 4/1998 | Shamir | 5/107 |
| 5,778,465 | A | 7/1998 | Myers | 5/99.1 |
| 5,806,113 | A * | 9/1998 | McMahan et al. | 5/109 |
| 7,203,981 | B1 * | 4/2007 | Cowgill | 5/109 |

(Continued)

FOREIGN PATENT DOCUMENTS

| | | |
|---|---|---|
| CN | 1240624 | 1/2000 |

(Continued)

*Primary Examiner* — Robert G Santos
*Assistant Examiner* — Nicholas Polito
(74) *Attorney, Agent, or Firm* — Miller Law Group, PLLC

(57) ABSTRACT

A bassinet for mounting on a play yard frame is supported to provide a swinging movement of the bassinet relative to the play yard. The bassinet is suspended from four detachable connector mounts that slide over the upper frame member of the play yard frame by three flexible support members and a single rigid support member that is operatively connected to a motor housed within a motorized connector mount to drive the swinging motion for the bassinet. The movement induced into the bassinet is controlled by the four support members to keep the bottom surface of the bassinet at a horizontal orientation throughout the swinging movement. The bottom board of the play yard is formed in segments which can be reconfigured to fit in the bassinet. The end segment can be folded below the remaining segments, or in the alternative removed, to affect the reconfiguration for the bassinet structure.

16 Claims, 12 Drawing Sheets

U.S. PATENT DOCUMENTS

| | | | | |
|---|---|---|---|---|
| 7,752,693 | B2 * | 7/2010 | Espenshade | 5/723 |
| 2001/0001330 | A1 | 5/2001 | Warner | |
| 2003/0177575 | A1 | 9/2003 | Cheng | 5/93.1 |
| 2006/0207022 | A1 * | 9/2006 | Jenkins | 5/93.1 |
| 2006/0225204 | A1 | 10/2006 | Bretschger | 5/99.1 |
| 2006/0225205 | A1 | 10/2006 | Troutman | 5/93.1 |
| 2006/0253978 | A1 | 11/2006 | Paesang | 5/93.1 |
| 2007/0214576 | A1 | 9/2007 | Espenshade | 5/273 |

FOREIGN PATENT DOCUMENTS

| | | |
|---|---|---|
| CN | 2427133 | 4/2001 |
| CN | 2539444 | 3/2003 |
| CN | 101015407 | 8/2007 |
| DE | 202007003533 | 7/2007 |
| GB | 2375298 | 11/2002 |

* cited by examiner

PLAY YARD WITH MOTORIZED SWINGING BASSINET

CROSS-REFERENCE TO RELATED APPLICATIONS

This application claims priority on U.S. Provisional Patent Application Ser. No. 61/001,428, filed on Nov. 1, 2007, entitled "Height Adjustable Changing Table for Play Yard"; on U.S. Provisional Patent Application Ser. No. 61/062,355, filed on Jan. 25, 2008, entitled "Play Yard with Motorized Bassinet"; and on U.S. Provisional Patent Application Ser. No. 61/125,733, filed on Apr. 28, 2008, entitled "Gliding Bassinet", the contents of each of these three provisional patent applications being incorporated herein by reference.

FIELD OF THE INVENTION

The present invention relates generally to a child's play yard enclosure and, more particularly, to a play yard having a bassinet attachment that can be moved relative to the play yard frame in a swinging motion, which can be motorized, and to a play yard bottom board that can be adjusted in size to fit the bassinet as well as the play yard.

BACKGROUND OF THE INVENTION

Play yards are used to contain and provide a safe environment for a child for sleeping or playing. Typically, play yards are collapsible so they can be stored or transported easily. Currently, play yards are manufactured with a frame that consists of a combination of assembled metal and plastic components with a fabric body that wraps around the frame to provide an enclosure to retain the child within the play yard. Play yards can be equipped with a bassinet assembly that can be supported by the play yard frame to establish an enclosed sleep area at a higher level than the bottom floor surface of the play yard to provide an easy access to the child without requiring the caregiver to bend to access the floor of the play yard.

ASTM (formerly the American Society for Testing and Materials) has adopted standards for the manufacture of structures, such as play yards, bassinets, cribs, etc., in which children are placed. One such standard (F 2088-08 6.6) establishes that a child, placed into a cradle swing in the most disadvantageous prone position, cannot create a bed surface that is greater than five (5) degrees from horizontal. Therefore, if a swing motion is desired for a child in a prone position, the surface on which the child rests must be maintained within 5 degrees of horizontal as the surface is moving in order to be in compliance with ASTM expectations.

Accordingly, it would be desirable to provide a bassinet structure that will allow a swinging movement of the bassinet without exceeding the five (5) degree prone child ASTM standard. The use of a bassinet mountable on a play yard enhances the usefulness of the play yard by providing a sleep area for an infant which is easily accessible to the caregiver.

In play yard structures, the floor of the enclosure is typically a foam or padded bottom board that is positioned on top of rigid structural members to provide a comfortable support for a child placed into the play yard. When a bassinet is placed into the play yard and suspended by the play yard frame, the space between the bottom of the bassinet and the bottom board of the play yard is insufficient to position a second child. Accordingly, the bassinet structure would preferably be configured to discourage the placement of a child on the bottom board of the play yard when the bassinet is installed on the play yard frame structure.

It would also be desirable to configure the bottom board of the play yard to be utilized as the bottom surface of the bassinet structure. To permit the bottom board to be used in both structures, the size of the bottom board needs to be adjusted as the surface area of the bottom surface of the bassinet is smaller than the surface area of the play yard.

U.S. Pat. No. 5,048,135, granted on Sep. 17, 1991, to Chin Chen, discloses a swinging mechanism for a child's crib in which the crib is suspended from a horizontal pivot axis to swing in a pendulum motion. The crib rocking apparatus shown in U.S. Pat. No. 3,769,641, issued on Nov. 6, 1973, to Marie Harper also provides a pendulum motion to a crib or bassinet. U.S. Pat. No. 5,274,863, granted to Roslyn Fountain on Jan. 4, 1994, teaches a hammock mounted for swinging motion on a playpen or a cot that has at least two sides extending upwardly from a bottom surface. The hammock structure is detachable supported by a plurality of cords emanating from the frame of the playpen. The cords can be positioned at the frame to permit a rocking movement of the hammock that can be induced into the hammock.

U.S. Pat. No. 4,615,059 granted on Oct. 7, 1986, to Waldemar Darowski discloses a rocking structure on which a crib or child's bed can be mounted so that a rocking motion can be induced into the crib or bed. The rocking structure utilizes a suspended frame to provide a rocking motion that keeps the crib or bed mounted thereon in a generally horizontal orientation. A rockable crib structure is disclosed in U.S. Pat. No. 5,742,960, issued to Yoav Shamir on Apr. 28, 1998, wherein the four legs of the crib structure are positioned on rocking supports that allow movement of the entire crib relative to the floor on which the rocking supports are positioned. A similar crib rocking apparatus is depicted in U.S. Pat. No. 4,258,446, granted on Mar. 31, 1981, to Irvin McAllister.

It would be desirable to provide an apparatus for suspending a bassinet from the frame of a play yard so that the bassinet can be swung gently relative to the frame of the play yard, preferably through a motorized swing mechanism connected to the bassinet.

It would also be desirable to provide a bottom board structure that can be converted from utilization on the bottom surface of the play yard to being utilized in a smaller bottom surface of a bassinet suspended from the play yard.

SUMMARY OF THE INVENTION

It is an object of this invention to provide a bassinet structure that can be selectively suspended from the frame of a play yard in a manner to be operable to move in a swinging motion relative to the play yard frame.

It is another object of this invention to provide a bassinet structure that incorporates a motorized swinging mechanism to affect a swinging motion to the bassinet relative to the play yard frame.

It is a feature of this invention that the bassinet is suspended from four members connected to the play yard frame.

It is an advantage of this invention that the four point suspension of the bassinet allows the bassinet to swing in a motion that always remains within five (5) degrees of being parallel to horizontal when a child is placed into the bassinet in a prone position.

It is another feature of this invention that the support members are affixed to connectors that are detachably mountable on the upper frame members of the play yard to support the bassinet for swinging motion.

It is another advantage of this invention that the detachable connectors can be easily mounted or removed for the installation and removal of the bassinet relative to the play yard.

It is still another feature of this invention that the motorized connector mount housing the motor for inducing swinging motion to the bassinet mounted on the play yard frame can be disconnected from the bassinet and retained on the play yard frame.

It is still another advantage of this invention that the disconnected motorized connector mount can be utilized to play music for or provide other auditory functions with respect to an infant placed into the play yard.

It is yet another feature of this invention that the suspension members associated with the detachable connector mounts, other than the motorized connector mount, are flexible members.

It is another advantage of this invention that the friction associated with the swinging suspension of the bassinet is reduced through the use of flexible suspension members.

It is still another feature of this invention that the support member associated with the motorized connector mount is a rigid member to induce a swinging motion to the bassinet mounted on the play yard frame.

It is yet another advantage of this invention that the rigid support member is removable from the motorized connector mount.

It is still another object of this invention to provide a bottom board for a play yard that can be reconfigured into a smaller size to be utilized in a bassinet mounted on the play yard frame.

It is a further feature of this invention that the bottom board is formed in segments.

It is still a further feature of this invention that at least one of the segments is removable from the other segments.

It is a further advantage of this invention that one of the bottom board segments can be folded beneath the remaining bottom board segments and stored beneath the remaining bottom board segments within the structure of the bassinet.

It is yet a further feature of this invention that the removable bottom board segment is attachable to the remaining bottom board segments by a tongue and groove connection that permits the detachment of the removable bottom board segment.

It is still a further advantage of this invention that the same bottom board used for the bottom support surface of the play yard is used for the bottom support surface of the bassinet after reconfiguration thereof.

It is yet a further advantage of this invention that the play yard will not have a bottom support surface on which a child can be properly placed when the bassinet is installed on the play yard for utilization.

It is yet another object of this invention to provide a bassinet that can be detachably supported on a play yard frame for a motorized swinging movement which is durable in construction, inexpensive to manufacture, carefree of maintenance, facile in assemblage, and simple and effective in use.

These and other objects, features and advantages are accomplished according to the instant invention by providing a bassinet for mounting on a play yard frame for support therefrom to allow for a swinging movement relative to the play yard. The bassinet is suspended from four detachable connector mounts that slide over the upper frame member of the play yard frame by three flexible support members and a single rigid support member that is operatively connected to a motor housed within a motorized connector mount to drive the swinging motion for the bassinet. The movement induced into the bassinet is controlled by the four support members to keep the bottom surface of the bassinet at a horizontal orientation throughout the swinging movement. The bottom board of the play yard is formed in segments which can be reconfigured to fit in the bassinet. The end segment can be folded below the remaining segments, or in the alternative removed, to affect the reconfiguration for the bassinet structure.

BRIEF DESCRIPTION OF THE DRAWINGS

The advantages of this invention will be apparent upon consideration of the following detailed disclosure of the invention, especially when taken in conjunction with the accompanying drawings wherein.

DETAILED DESCRIPTION OF THE PREFERRED EMBODIMENT

Figure 1:
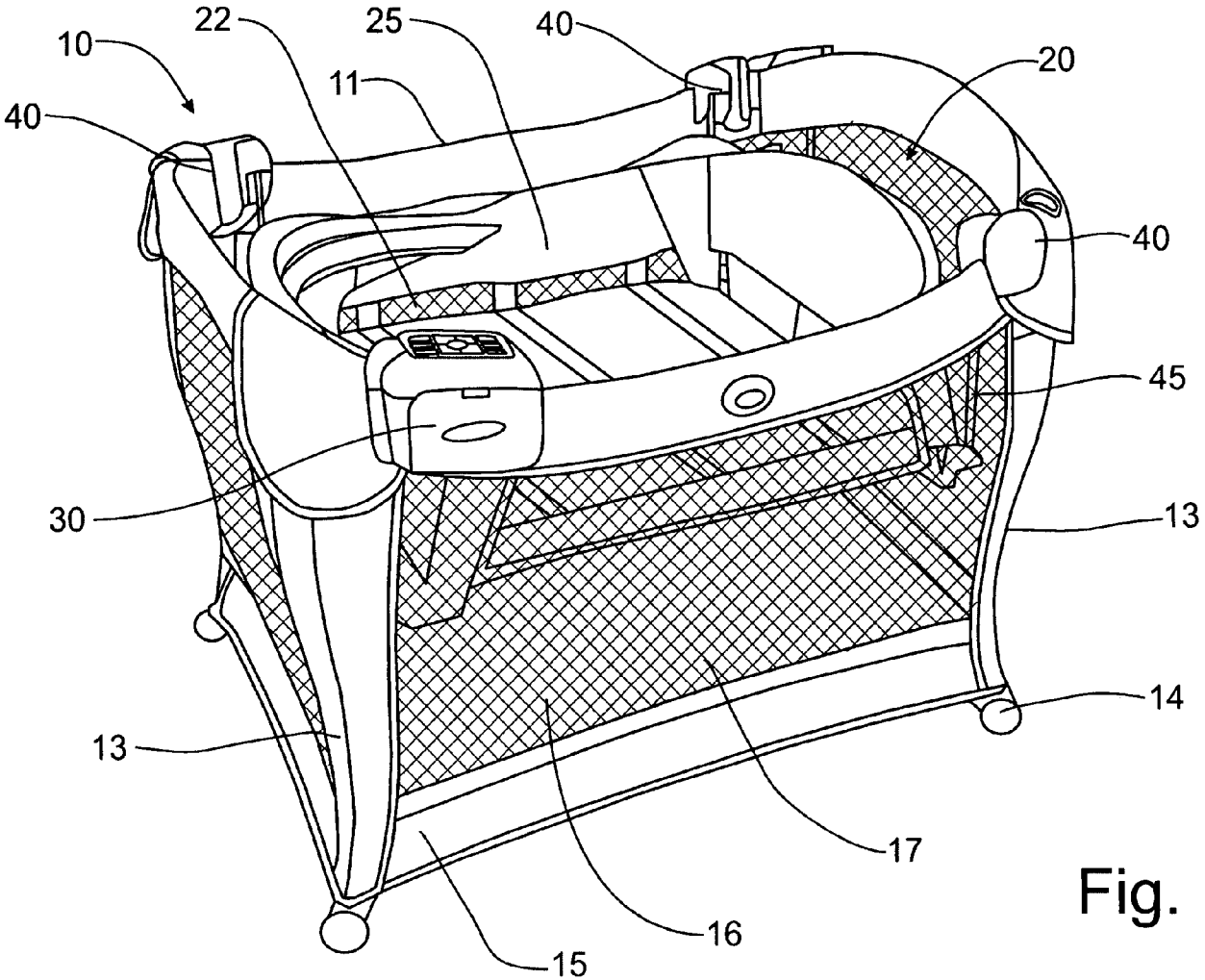
FIG. 1 is a perspective view of a play yard having a bassinet mounted on the upper frame member according to the principles of the instant invention.

Referring now to FIGS. 1-4, a play yard having a bassinet mounted on the upper frame members of the play yard and incorporating the principles of the instant invention can best be seen. The play yard 10 incorporates a frame structure that is covered by the fabric body 15, but includes upper frame members 11 defining a generally rectangular shape around the top of the play yard 10 to establish the upper boundary of the play yard, lower frame members 12 positioned below the upper frame members 11 and providing a generally rectangular support for the floor member 19 of the play yard 10, and vertical frame members 13 interconnecting the upper and lower frame members 11, 12 and defining the corners of the play yard 10. The vertical frame members 13 terminate in respective foot members 14 that are attached to the vertical frame members 13 to engage the floor support surface on which the play yard is disposed.

While the preferred embodiment of the play yard 10 defines the upper boundary of the play yard by the upper frame member 11 supported by vertically extending frame members 13 which extend upwardly from the lower frame members 12, one skilled in the art will recognize that the frame configuration of the play yard 10 could be substantially different. For example, the upper boundary of the play yard 10 could be formed from the soft goods, i.e. fabric that is stretched taut between vertically extending frame members or posts. The frame configuration of the play yard 10 might not have vertical frame members or posts that form the corners of the play yard 10. The vertical frame members could be oriented diagonally along the sides of the play yard 10 with the soft goods defining the vertical corners of the play yard 10 extending between upper and lower frame members. One skilled in the art will recognize that in all play yard configurations, the play yard 10 will have an upper boundary, a bottom and sides extending between the upper boundary and the bottom supported by a frame structure.

The fabric body 15 forms an enclosure around the periphery of the play yard 10. The fabric body 15 is preferably formed with an upper tunnel through which the upper frame members 11 are placed to support the upper portion of the fabric body. The fabric body 15 is then drawn taut around the vertical frame members 13 and the lower frame members 12 and secured to the play yard frame. The fabric body 15 preferably includes generally vertical mesh portions 16 to facilitate viewing a child positioned on the play yard floor 19. The fabric body 15 can also includes a fabric panel 17 that is pulled taut across the bottom of the play yard 10 so as to be positionable between the lower frame members 12 and the removable floor surface 19.

As best seen in FIGS. 1-4, the bassinet 20 has a similar, though smaller, frame structure to the play yard 10. The frame of the bassinet 20 includes upper support tubes 21 that define a generally rectangular shape around the top of the bassinet 20. The fabric body 25 of the bassinet 20 is formed with a reinforced fabric panel 22 extending from the sides of the fabric body 25 and supported from the upper support tubes 21. Preferably, generally vertical corner pieces 23 depend downwardly from the upper support tubes 21 to provide additional support and rigidity to the bassinet structure and define corners of the bassinet 20. The bottom support surface 24, which as will be described in greater detail below can be a reconfigured bottom board 60 from the play yard floor 19, rests on the reinforced fabric panel 17 to establish a bottom support surface 24 on which an infant can be placed.

According to the principles of the instant invention, the bassinet 20 is supported from four detachable connector mounts 30, 40 mounted on the upper frame members 11 of the play yard 10. One of the connector mounts 30 incorporates a drive mechanism 50, as will be described in greater detail below, to affect a swinging motion to the bassinet 20. The motorized connector mount 30 can be constructed to provide a simple oscillatory movement to the bassinet 20 which is transferred to the frame of the bassinet 20 by a rigid drive member 35 that interconnects the drive mechanism 50 in the motorized connector mount 30 and a corresponding corner piece 23. The remaining three corner pieces 23 of the bassinet 20 are connected to corresponding connector mounts 40 by flexible support members 45 to establish a four bar support linkage utilizing the rigid drive member 35 and the three flexible support members 45. Thus, as the drive mechanism 50 oscillates the bassinet frame, the bottom support surface 24 moves from end to end in a parallel manner, maintaining a horizontal orientation throughout the swinging movement of the bassinet 20.

Figure 5:
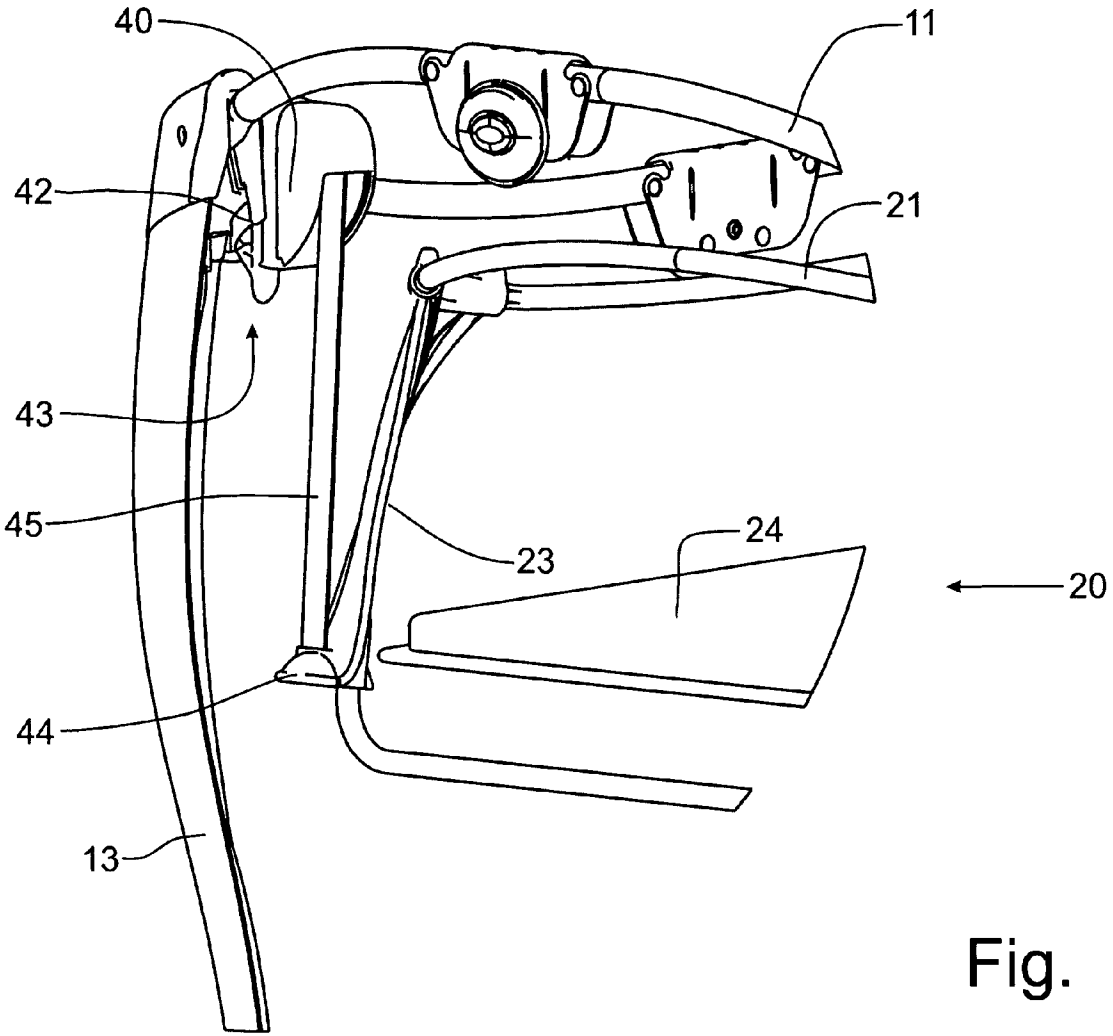
FIG. 5 is an enlarged perspective view of a portion of the play yard with bassinet mounted thereon to show the detachable connector mount utilizing a flexible support member to suspend the bassinet from the play yard frame.
Figure 6:
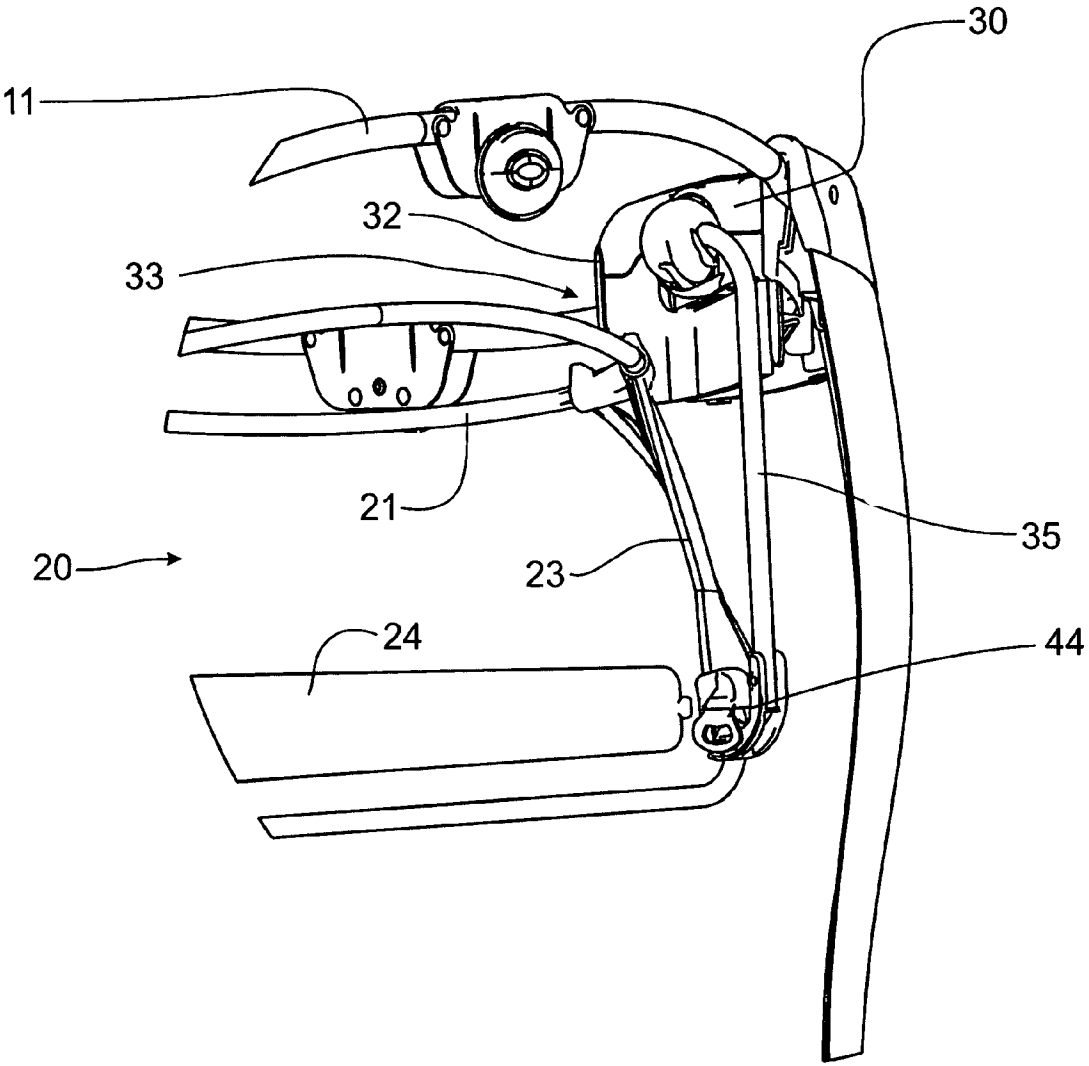
FIG. 6 is an enlarged perspective view of a portion of the play yard with a bassinet mounted thereon to show the detachable motorized connector mount and the rigid support member associated therewith.
Figure 8:
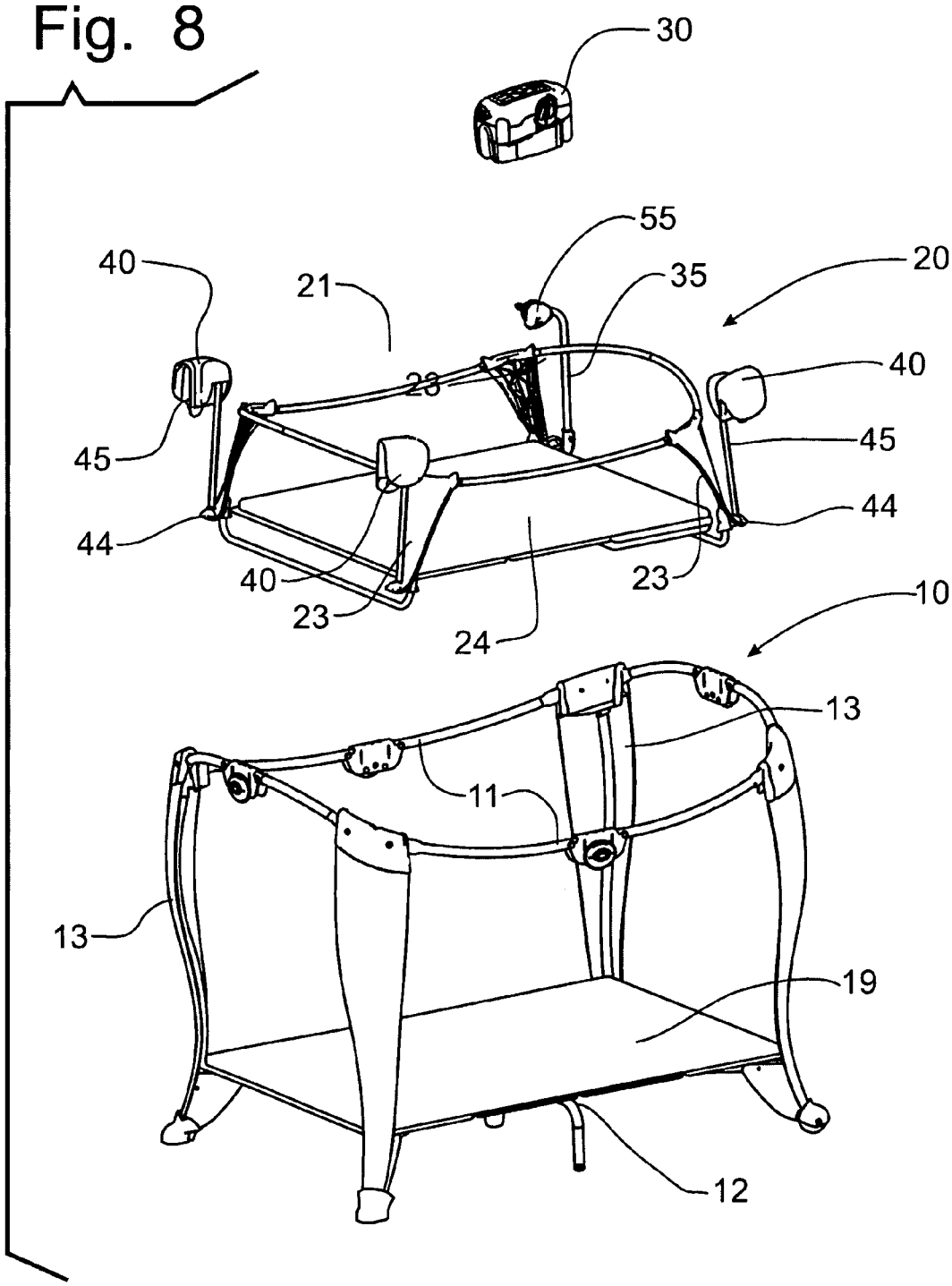
FIG. 8 is an exploded view of the play yard frame with a bassinet mountable thereon, as depicted in FIG. 2.

As is best seen in FIGS. 1-6 and 8, each connector mount 30, 40 is formed with a U-shaped housing 32, 42, respectively, that defines a channel 33, 43, respectively, that is sized to fit over top of the upper frame members 11 of the play yard 10. One skilled in the art will note that the overall size of the motorized connector mount 30 is substantially greater than the simple connector mounts 40, due to the spatial requirements for housing the drive mechanism 50, nevertheless, the overall configurations of the U-shaped housings 32, 42, are essentially identical. The channel 33, 43 is designed to slide over the top of the upper frame member 11 and have sufficient depth as to retain the upper frame member 11 within the channel 33, 43. Thus, the connector mounts 30, 40 are easily installed on and removed from the frame of the play yard 10, The flexible support members 45 are attached to the U-shaped housings 42 and project downwardly therefrom to connect to a mounting flange 44 on a bottom portion of the corresponding corner piece 23, as is best seen in FIGS. 5 and 8. Similarly, as reflected I FIG. 6, the rigid drive member 35 connects to the mounting flange 44 on the corresponding corner piece 23, extending from the drive motor 50 to transfer oscillatory motion to the bassinet 20 through the attached corner piece 23. With the three flexible support members 45 having equal length and a corresponding length for the rigid drive member 35, the bottom support surface 24 of the bassinet 20 is oriented horizontally for a proper positioning of a prone child thereon. Furthermore, the weight of the bassinet frame pulling downwardly on the rigid drive member 35 and the flexible support members 45 helps to retain the connector mounts 30, 40 on the upper frame members 11 of the play yard 10.

Figure 7:
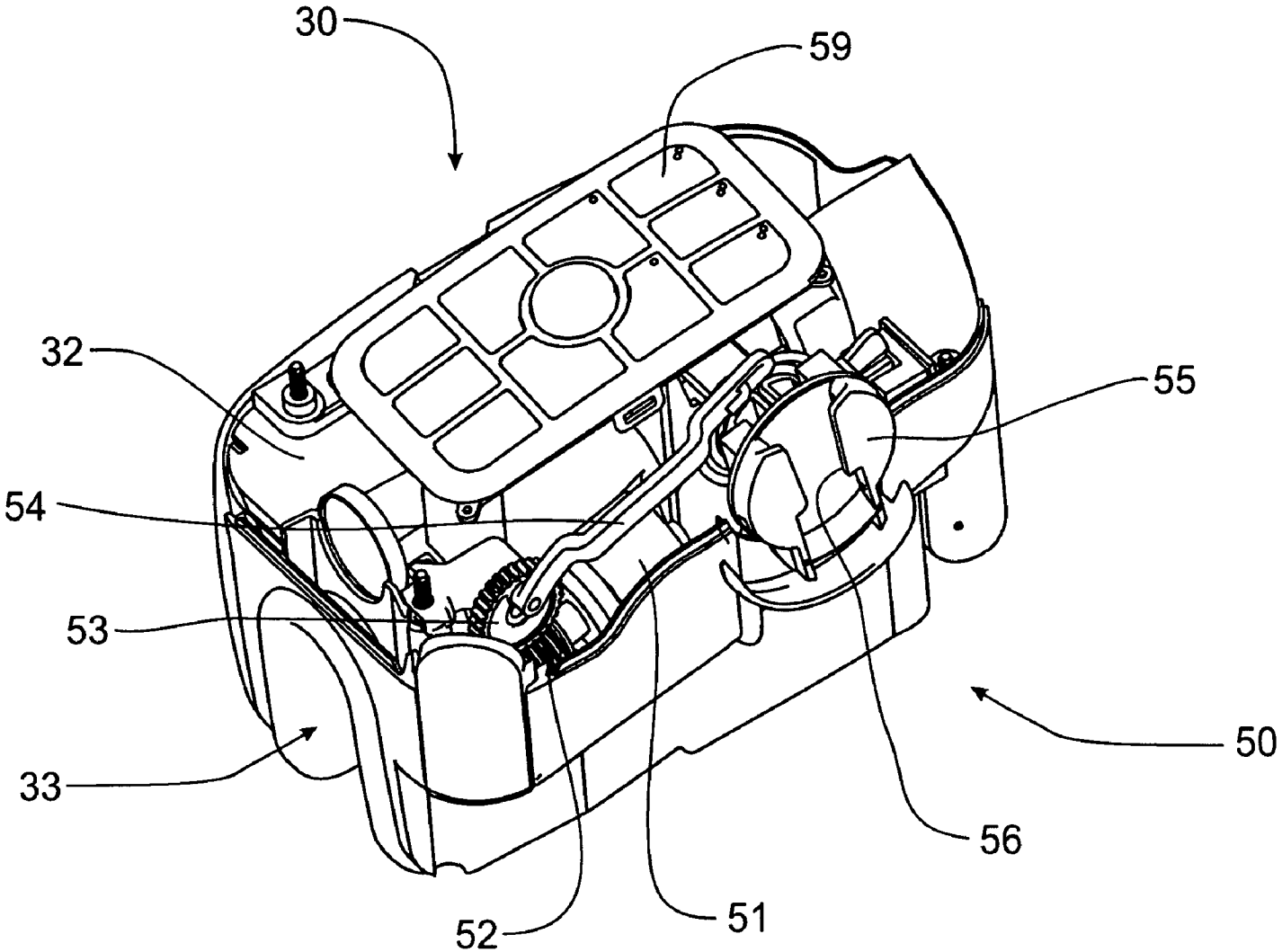
FIG. 7 is an enlarged perspective detail view of the motorized connector mount with a portion of the cover removed to view the drive components.

Referring now to the schematic representation of the drive mechanism 50 in FIG. 7, one skilled in the art will understand that the drive mechanism 50 can incorporate a drive motor 51 that is electrically powered through the DC electrical current provided by batteries or by a DC current provided through an AC adapter (not shown) to rotate a worm gear 52. A drive gear 53 rotatably supported on the housing 32 is engaged with the worm gear 52 to be rotated therewith about the axis of the drive gear 53. A connecting rod 54 is pinned to the drive gear 53 eccentrically of the axis of the drive gear 53. The distal end of the connecting rod 54 is affixed to a rocker member 55 that is pivotally mounted on the housing 32. Thus, as the pinned end of the connecting rod 54 rotates about the axis of the rotating drive gear 53, the distal end of the connecting rod 54 is oscillated back and forth in a linear fashion, causing a pivotal movement of the rocker member 55. The rigid drive member 35 is detachably mounted to the rocker member 55 by sliding into the mounting slot 56 formed on the exterior of the rocker member 55 to transfer a swinging motion to the frame of the bassinet 20.

Figure 9:
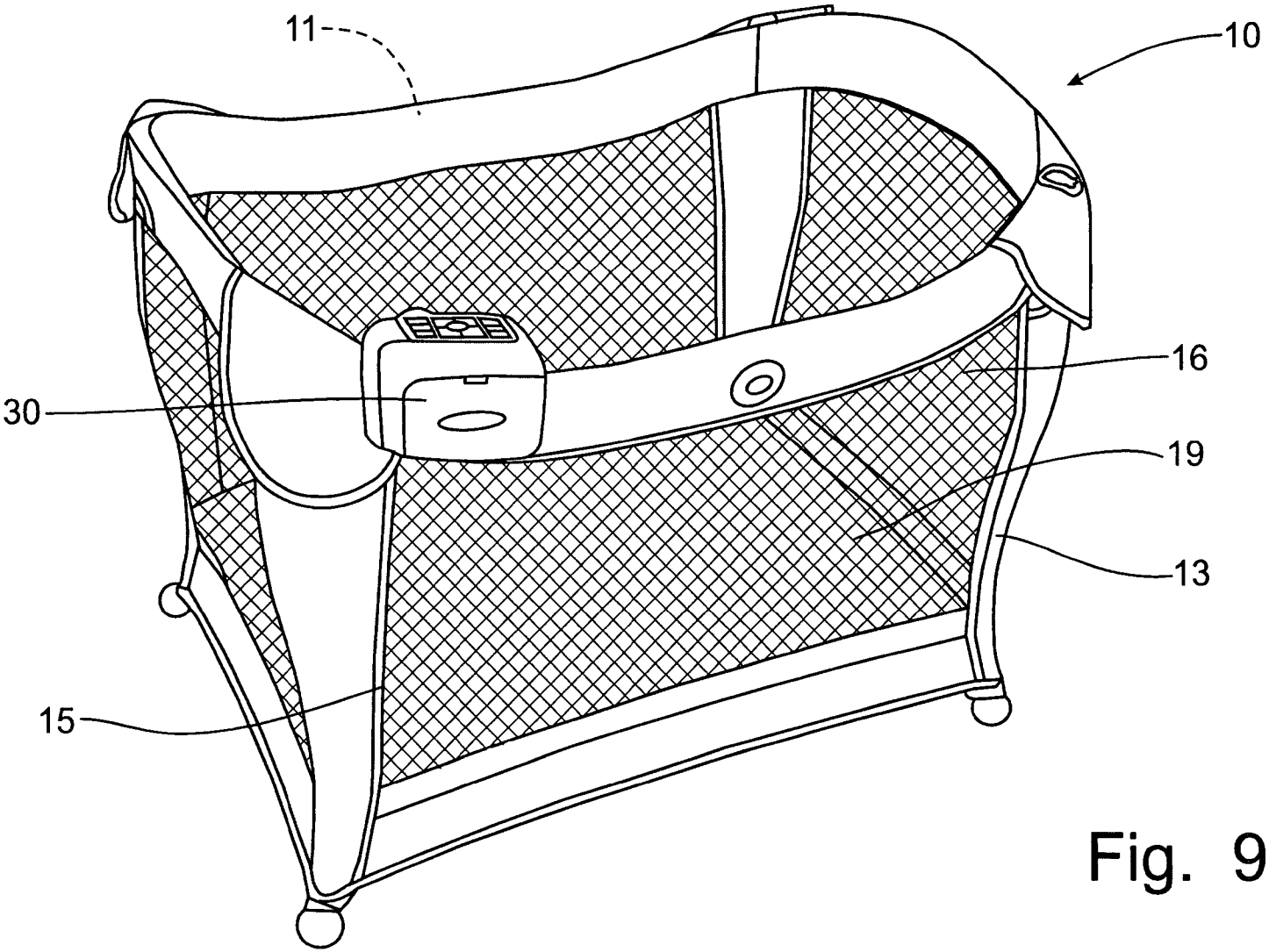
FIG. 9 is a perspective view of the play yard similar to that of FIG. 1, but depicting the bassinet structure being removed except for the motorized connector mount to provide auditory functions with respect to a child placed on the bottom surface of the play yard.
Figure 10:
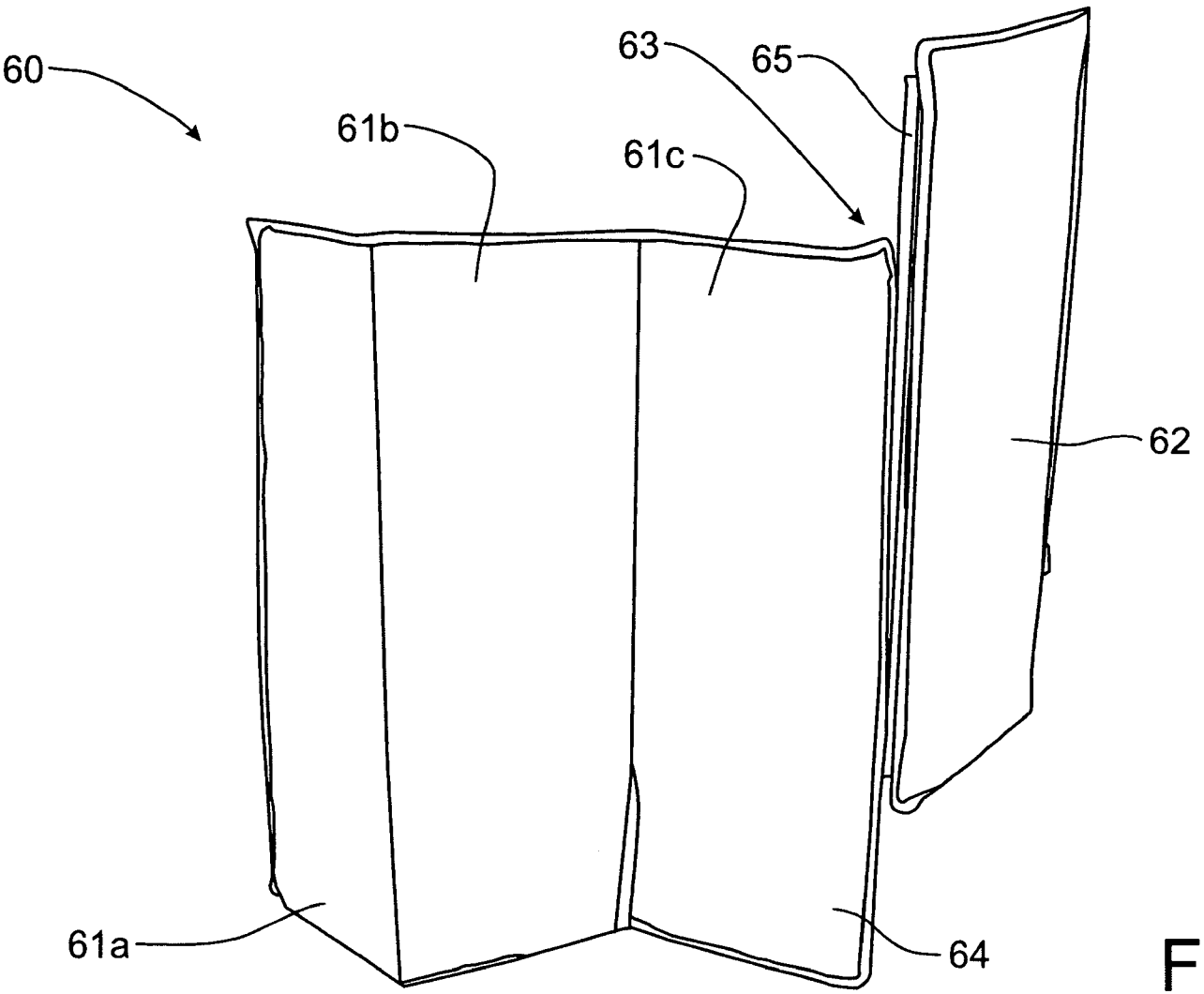
FIG. 10 is a perspective view of the bottom board of the play yard formed in segments according to the principles of the instant invention, the removable segment being partially detached from the remaining segments.
Figure 11:
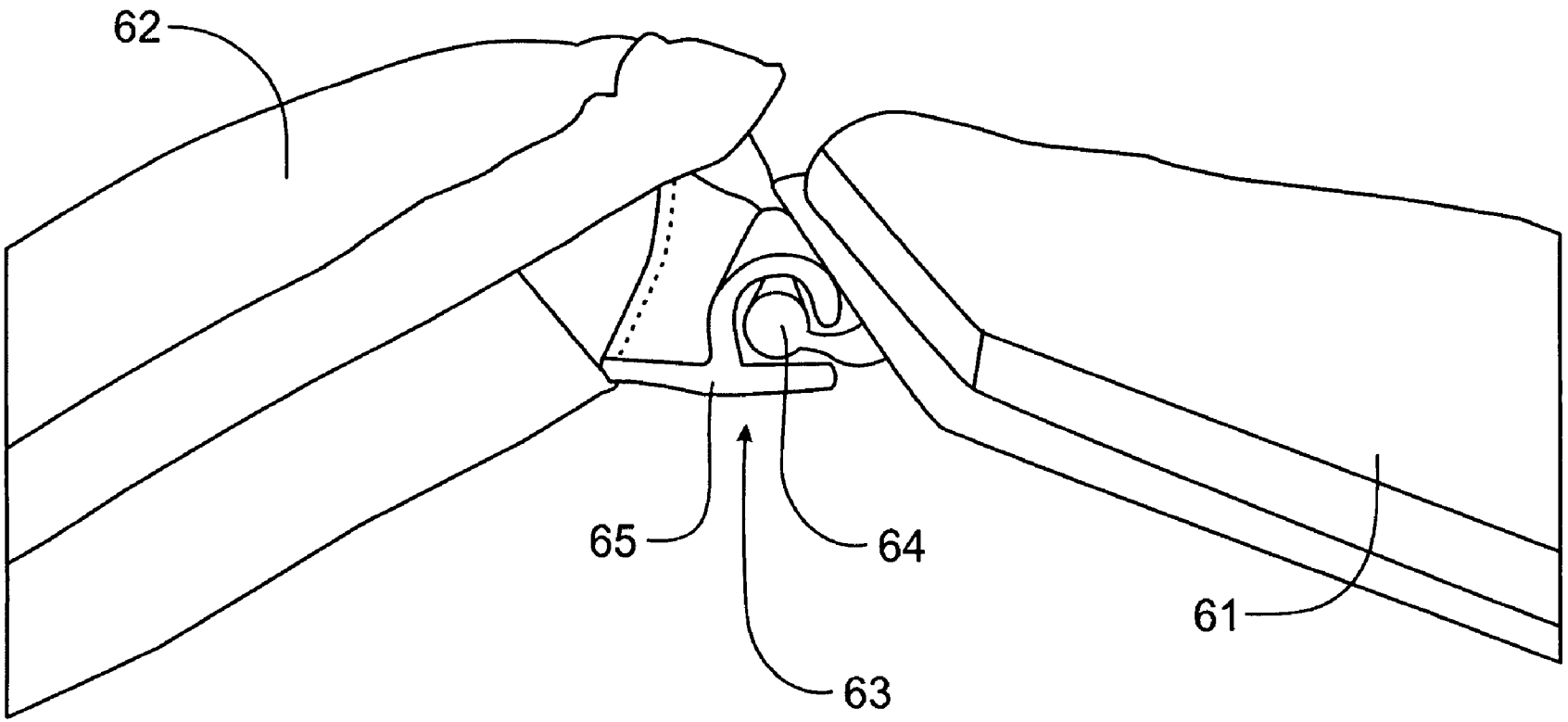
FIG. 11 is an enlarged detail perspective view of the tongue and groove connector mechanism operable to attach the removable segment of the bottom board to the remaining segments.
Figure 12:
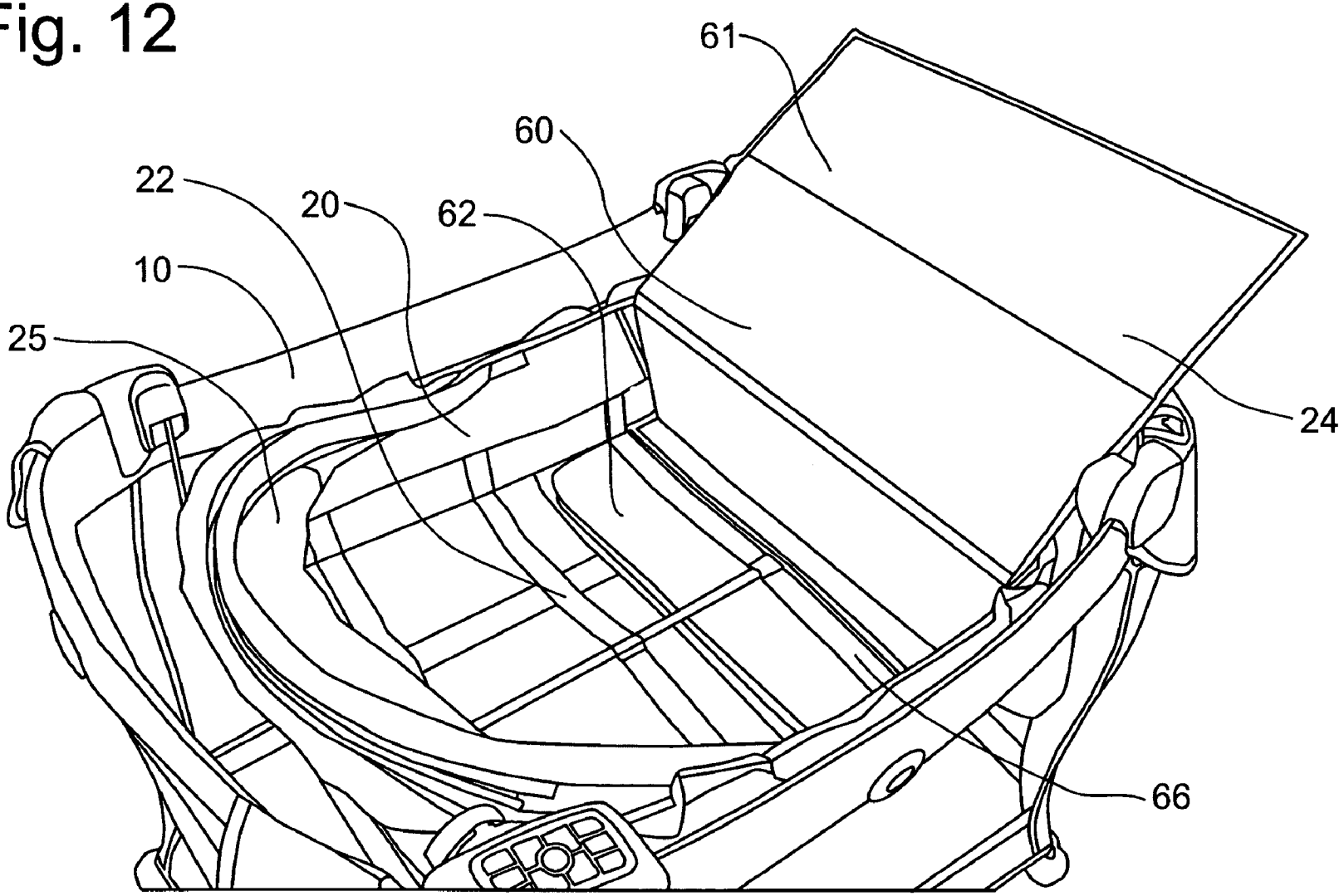
FIG. 12 is a perspective view of another embodiment of the bottom board formed in segments, but the end segment is foldable for placement in a storage pocket of the bassinet.

Preferably, the drive mechanism 50 is also associated with an electronic control mechanism 59, represented schematically in FIG. 7, to control the speed of operation of the drive motor 51 and, thus, the rate of oscillation of the bassinet 20. The electronic control mechanism 59 of the drive mechanism 50 can also incorporate a number of other functions, including among other things a memory that can play music. Accordingly, the motorized connector mount 30 can be disconnected from the bassinet 20 by disengaging the rigid drive member 35 from the mounting slot 56 on the rocker member 55 to allow the motorized connector mount 30 to be retained on the upper frame member 11 of the play yard 10 to provide a source of music for the infant placed onto the floor 19 after the bassinet 20 has been removed from the play yard 10, as is depicted in FIG. 9.

As is shown in FIGS. 1 and 10-12, the bottom board 60 is formed in a segmented manner so as to be somewhat flexible in handling and to permit the bottom board 60 to be reconfigured to a smaller size to fit into the bassinet 20 to form the bottom support surface 24. In the preferred embodiment depicted in FIG. 12, the end segment 62 is foldable about the fabric hinge connecting the end segment 62 to the remaining segments 61 to affect a reconfiguration of the size of the bottom board 60 from a four segment size that fits the bottom of the play yard 10 to form the floor 19 thereof, to a three segment size that corresponds to the bottom support surface 24 of the bassinet 20. In this preferred embodiment, the end segment 62 is folded completely underneath the remaining segments 61 and preferably tucked into a specially formed pocket 66 in the fabric body 25 of the bassinet 20 so that the remaining segments 61 form a flat, horizontal bottom support surface 24 on which to repose an infant.

In an alternative embodiment, one or more of the individual segments 62 can be disconnected from the other remaining segments 61 to reduce the overall size of the bottom board 60. Preferably, three of the segments 61*a*-61*c* are connected together in a single package that will allow some bending of one segment 61*a*-61*c*, relative to the adjacent segment 61*a*-61*c*, but not allow the segments 61*a*-61*c* to be disconnected from one another. The fourth segment 62, however, is detachably connected to the other segments 61 through a connector 63, which is preferably in the form of a tongue and groove assembly having a formed tongue 64 mating with a formed groove structure 65 that allows the tongue 64 to be inserted at the lateral end of the groove structure 65 and slid along the groove structure 65 until the detachable segment 62 is aligned with the remaining segments 61. This tongue 64 and groove 65 assembly allows some bending flexibility of the detachable segment 62 from the remaining segments 61. One skilled in the art will recognize that all of the individual segments 61*a*, 61*b*, 61*c*, 62 could be connected to the adjacent segment by a tongue and groove assembly so that each of the segments can be separated from the other segments.

Figure 2:
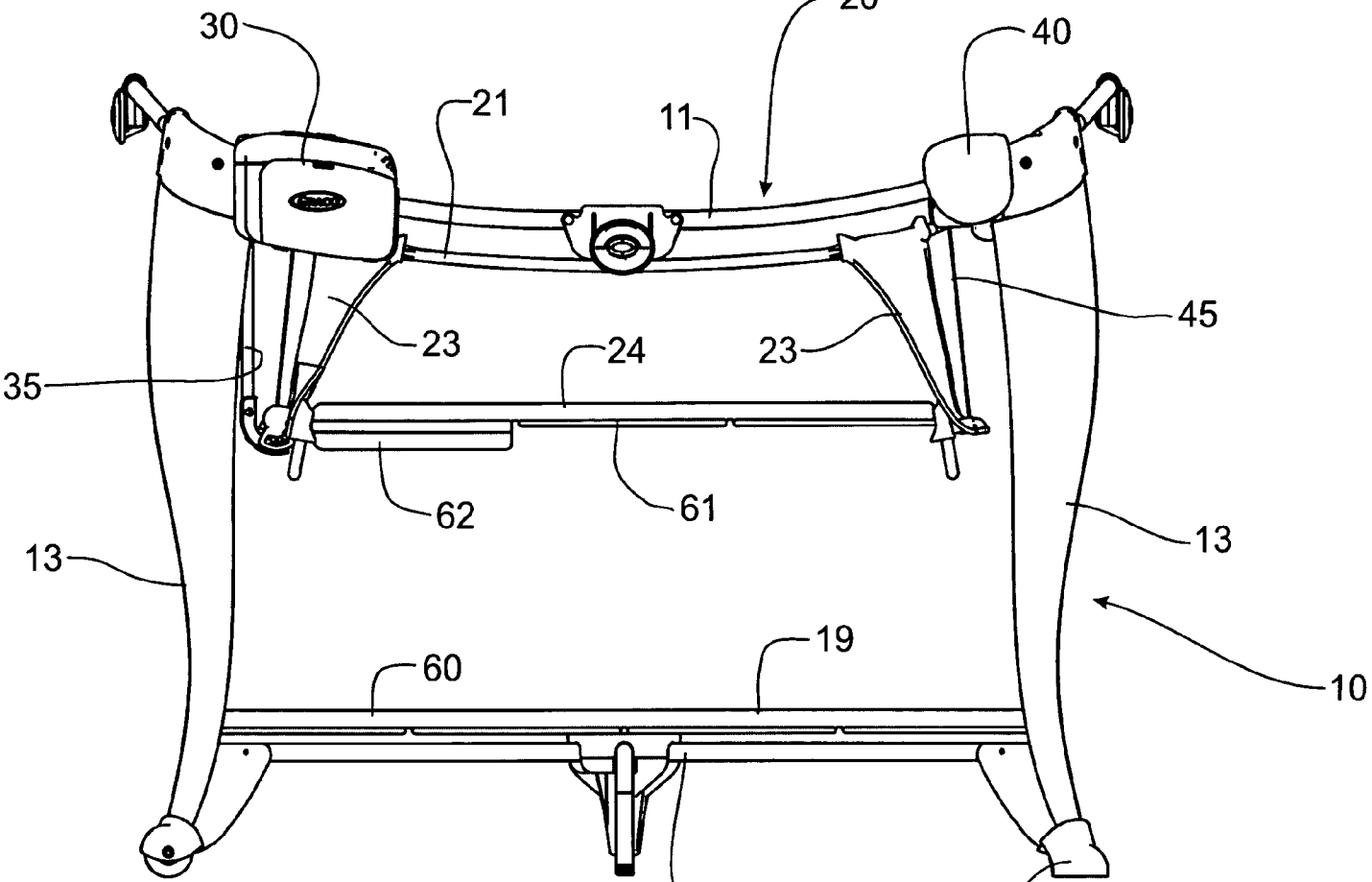
FIG. 2 is a side elevational view of the frame members of the play yard having a bassinet suspended therefrom according to the principles of the instant invention, the bottom board being shown on both the play yard and the bassinet and the fabric body comprising the soft goods being removed for purposes of clarity.
Figure 3:
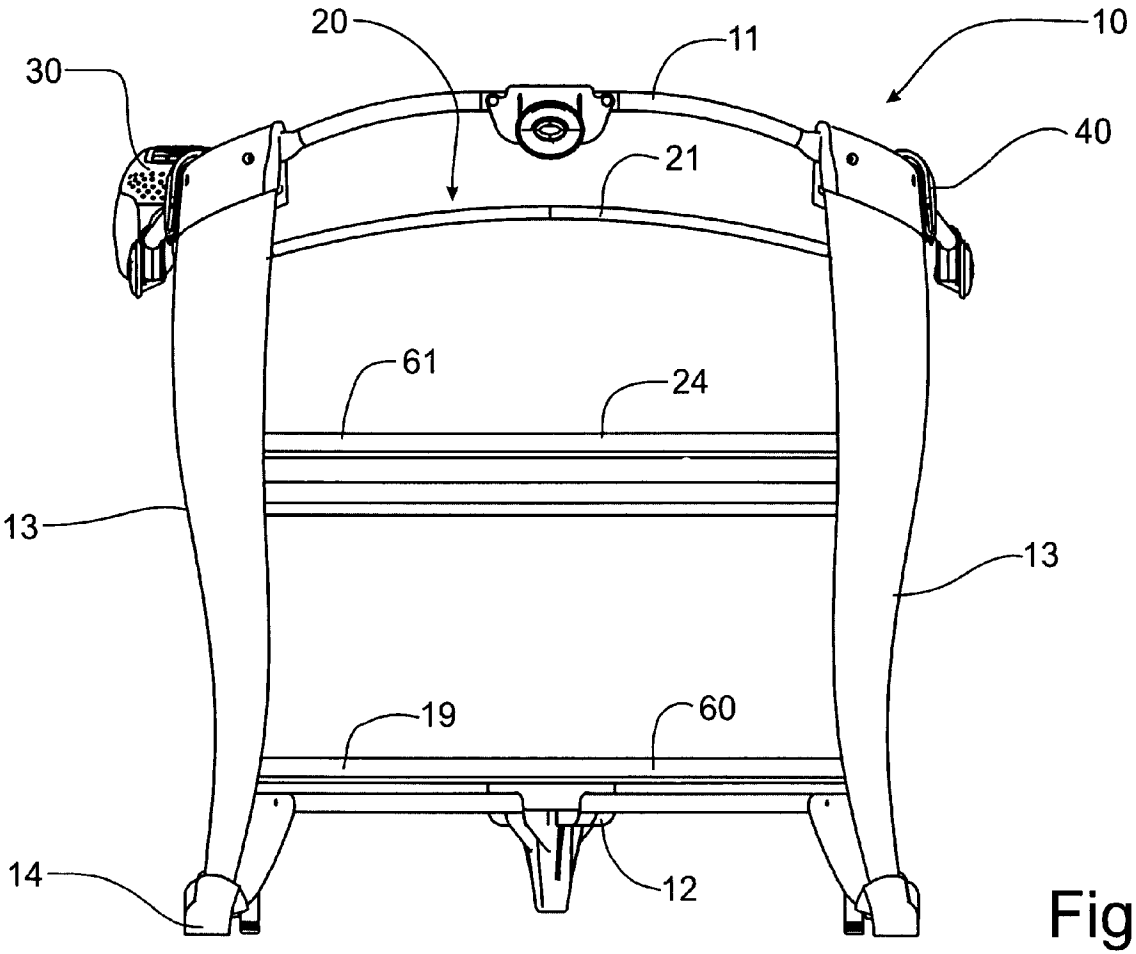
FIG. 3 is an end elevational view of the frame components for the play yard and bassinet as depicted in FIG. 2.
Figure 4:
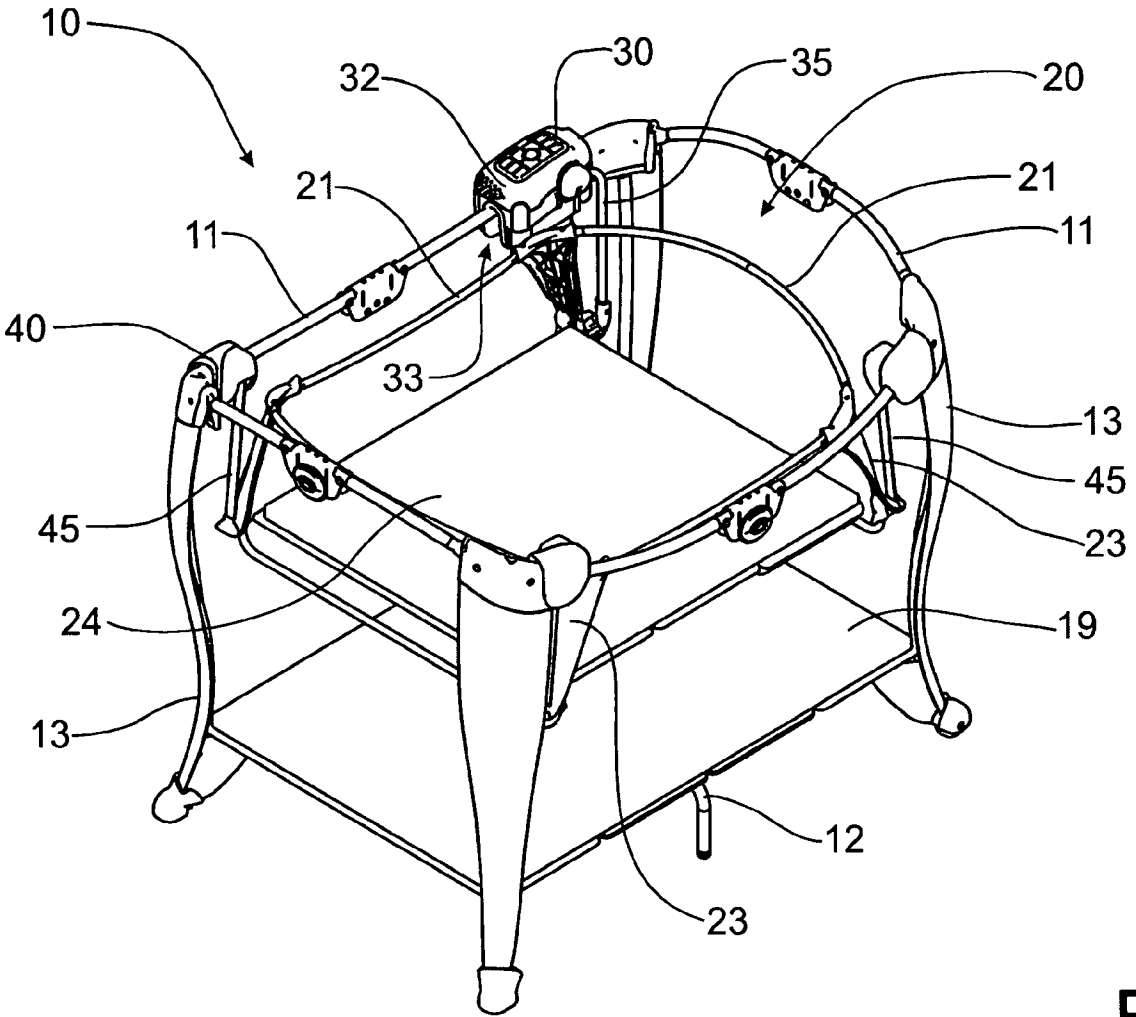
FIG. 4 is a perspective view of the frame components shown in FIG. 2.

The bottom board 60, as is shown in FIG. 2, can be supported by the lower frame members 12 of the play yard to form the floor 19 thereof with all segments 61, 62 connected together to form the full bottom board 60. Since the bassinet 20 cannot be mounted on the upper frame members 11 while the floor 19 is being utilized to support a child, the bottom support surface 24 of the bassinet 20 can be established by the bottom board 60 removed from the lower frame members 12 and reconfigured to fit onto the bassinet 20. To accomplish this reconfiguration, the end segment 62 is folded under or detached from the remaining segments 61 to reduce the overall size of the bottom board 60 in a manner to fit on the reinforced fabric panel 22 in the bassinet 20. Preferably, the end segment 62 can be stored beneath the reconfigured bottom board 60, such as in a pocket formed beneath the bassinet bottom surface 24 to receive and store the end segment 62. This configuration leaves the bottom surface 24 of the bassinet 20 in a level horizontal orientation for proper positioning of a prone infant. To return the bottom board 60 to the play yard floor 19, the reconfigured bottom board 60 is returned to the full size by unfolding or reattaching the end segment 62 with respect to the remaining segments after being removed from the bassinet 20 so that the full sized bottom board 60 can be replaced into the bottom of the play yard 10 to serve as the floor 19 therefor, thus rendering the bassinet 20 unusable.

It will be understood that changes in the details, materials, steps and arrangements of parts which have been described and illustrated to explain the nature of the invention will occur to and may be made by those skilled in the art upon a reading of this disclosure within the principles and scope of the invention. The foregoing description illustrates the preferred embodiment of the invention; however, concepts, as based upon the description, may be employed in other embodiments without departing from the scope of the invention.

Having thus described the invention, what is claimed is:

1. A play yard comprising:

a frame structure supporting an upper boundary member, a bottom member and sides extending between said upper boundary member and said bottom member; and a bassinet having a bottom support surface and being detachably supported from said upper boundary member by elongated, generally vertically oriented support members that are pivotally supported on both said bottom support surface and said upper boundary member so that said upper boundary member, said bottom support surface of said bassinet and said support members form a four-bar linkage that permits the bassinet to be oscillated relative to said upper boundary members while keeping said bottom support surface in a generally horizontal orientation throughout said oscillation of said bassinet, each said support member being pivotally connected to a connector mount that is detachably mounted on said upper boundary member, a first one of said support members being a rigid drive member operatively connected to a drive mechanism for affecting oscillation of said bassinet.

2. The play yard of claim 1 wherein said first one of said support members being detachably connected to said drive mechanism.

3. The play yard of claim 2 wherein said connector mount corresponding to said rigid drive member houses said drive mechanism.

4. The play yard of claim 3 wherein each of said support members other than said first support member is a flexible support member interconnecting a corresponding said connector mount and said bassinet.

5. The play yard of claim 4 wherein said bassinet includes upper support tubes and corner members extending generally vertically from said upper support tubes, each said corner member being formed with a mounting member for connection of said corner member to a corresponding said support member.

6. The play yard of claim 5 wherein the disconnection of said rigid drive member from said drive mechanism permits said first connector mount to be disconnected from said bassinet and retained on said upper boundary member.

7. The play yard of claim 3 wherein each said connector mount is formed with a U-shaped housing defining a channel that is sized to receive said upper boundary member therein, each said connector mount being shaped to slide over the top of said upper boundary member.

8. A bassinet for mounting onto a play yard having upper boundary, comprising:

a frame structure;

a bottom support member supported from said frame structure;

a plurality of connector mounts detachably supportable on said upper boundary;

a drive mechanism housed in one of said connector mounts and being operable to induce an oscillatory movement into said bassinet when mounted on said upper boundary; and a support member pivotally interconnecting each of said connector mounts with said frame structure to establish a swinging support for said bassinet via swinging of the support members when mounted on said upper boundary of said play yard so that said bottom support member will retain a generally horizontal orientation parallel to said upper boundary during oscillatory movement thereof, a first said support member being a rigid support member detachably connected to said drive mechanism to induce said oscillatory movement into said bassinet.

9. The play yard of claim 8 wherein the remaining said support members other than said first support member are fixed to the corresponding said connector mounts such that the remaining said support members and corresponding connector mounts are removable from said play yard with said bassinet.

10. The bassinet of claim 9 wherein each said support member other than said first support member is a flexible member.

11. The bassinet of claim 10 each said connector mount is formed with a channel that allows the connector mount to be mounted on top of said upper boundary with a portion of said upper boundary being received within said channel.

12. The bassinet of claim 11 wherein the disconnection of said rigid support member from said drive mechanism allows said bassinet to be disconnected from said first connector mount and allow said first connector mount to be retained on said upper boundary without said bassinet being attached.

13. The bassinet of claim 8 wherein said bottom support member includes a bottom board formed with a first segment and a second segment, said first segment being movable relative to said second segment to allow said bottom board to be sized to correspond to two differently sized bottom support members.

14. The bassinet of claim 13 wherein said second segment is sized to fit on said bottom support member, said first segment being stored beneath said second segment when deployed on said bottom support member.

15. The bassinet of claim 14 wherein said first segment is removable from said second segment, said first and second segments being connected through a tongue and groove connector device.

16. The bassinet of claim 15 wherein said second segment is formed of multiple individual segments.

* * * * *